US007344425B2

(12) United States Patent
Yeh

(10) Patent No.: US 7,344,425 B2
(45) Date of Patent: Mar. 18, 2008

(54) SLIDING BOARD HAVING REINFORCED STRUCTURE

(76) Inventor: Tzong In Yeh, 4566 Crestwood St., Fremont, CA (US) 94538

( * ) Notice: Subject to any disclaimer, the term of this patent is extended or adjusted under 35 U.S.C. 154(b) by 0 days.

(21) Appl. No.: 11/543,045

(22) Filed: Oct. 5, 2006

(65) Prior Publication Data

US 2007/0173144 A1 Jul. 26, 2007

(30) Foreign Application Priority Data

Jan. 26, 2006 (TW) ..... 95103223 A

(51) Int. Cl.
*B63B 35/81* (2006.01)

(52) U.S. Cl. ..... 441/74; 441/65

(58) Field of Classification Search ..... 114/357; 441/65, 74

See application file for complete search history.

(56) References Cited

U.S. PATENT DOCUMENTS 3,577,576 A * 5/1971 Lobb et al. ..... 441/74
4,209,867 A * 7/1980 Abrams, III ..... 441/74
2003/0008575 A1* 1/2003 Leonard ..... 441/65

* cited by examiner

*Primary Examiner*—Lars A. Olson
(74) *Attorney, Agent, or Firm*—Rosenberg, Klein & Lee

(57) ABSTRACT

A sliding board includes a board body made of a light material, and at least one reinforcing unit mounted in the board body to reinforce a structural strength of the board body and including a plurality of reinforcing bars which are connected serially to form the reinforcing unit. Thus, the reinforcing bars are connected with each other to assemble the reinforcing unit so that the length of the reinforcing unit is adjustable so as to fit the board body of different length.

15 Claims, 8 Drawing Sheets

SLIDING BOARD HAVING REINFORCED STRUCTURE

BACKGROUND OF THE INVENTION

1. Field of the Invention

The present invention relates to a sliding board, and more particularly to a sliding board, such as a bodyboard, surfboard, snowboard, slider and the like.

2. Description of the Related Art

A conventional sliding board, such as a bodyboard, surfboard, snowboard, slider and the like, comprises a board body, a surface layer bonded onto the top face of the board body, and a bottom plate is bonded onto the bottom face of the board body. However, the board body is made of a light material, such as a foam material of PE, PP, PS or the like, so that the board body is easily broken or deformed due to a bending force.

The closest prior art references of which the applicant is aware were disclosed in U.S. Pat. Nos. 4,798,549; 5,816,875; and 6,800,006B1. In the above-mentioned prior art references, a reinforcing bar or stringer is embedded in the board body to enhance the structural strength of the board body. However, the reinforcing bar is formed integrally and has a fixed length so that the reinforcing bar is only available for the specific board body upon its length; thereby versatilities of the reinforcing bar for various board bodies are limited, and the costs of fabrication and production are increased.

SUMMARY OF THE INVENTION

The present invention is to mitigate and/or obviate the disadvantage of the conventional sliding board.

The primary objective of the present invention is to provide a sliding board having a reinforced structure.

Another objective of the present invention is to provide a sliding board, wherein the reinforcing bars are connected with each other to assemble the reinforcing unit so that the length of the reinforcing unit is adjustable so as to fit the board body of different length.

A further objective of the present invention is to provide a sliding board, wherein the space formed by the outer rib, the space formed by the inner rib, and the inner space formed by the through hole are filled with the light material of the board body, so that each of the reinforcing bars of the reinforcing unit is combined with the board body closely, thereby enhancing the whole structural strength of the sliding board.

A further objective of the present invention is to provide a sliding board, wherein the insert of the male mounting portion is inserted into the slot of the respective female mounting portion, and the snapping bosses of the male mounting portion are snapped into and locked in the snapping holes of the respective female mounting portion, so that the male mounting portion is combined with the respective female mounting portion, and the reinforcing bars are connected rigidly and stably.

A further objective of the present invention is to provide a sliding board, wherein the male mounting portion is connected with the respective female mounting portion easily and rapidly, so that the reinforcing bars are connected with each other so as to assemble the reinforcing unit easily and rapidly.

Further benefits and advantages of the present invention will become apparent after a careful reading of the detailed description with appropriate reference to the accompanying drawings.

DETAILED DESCRIPTION OF THE INVENTION

Figure 1:
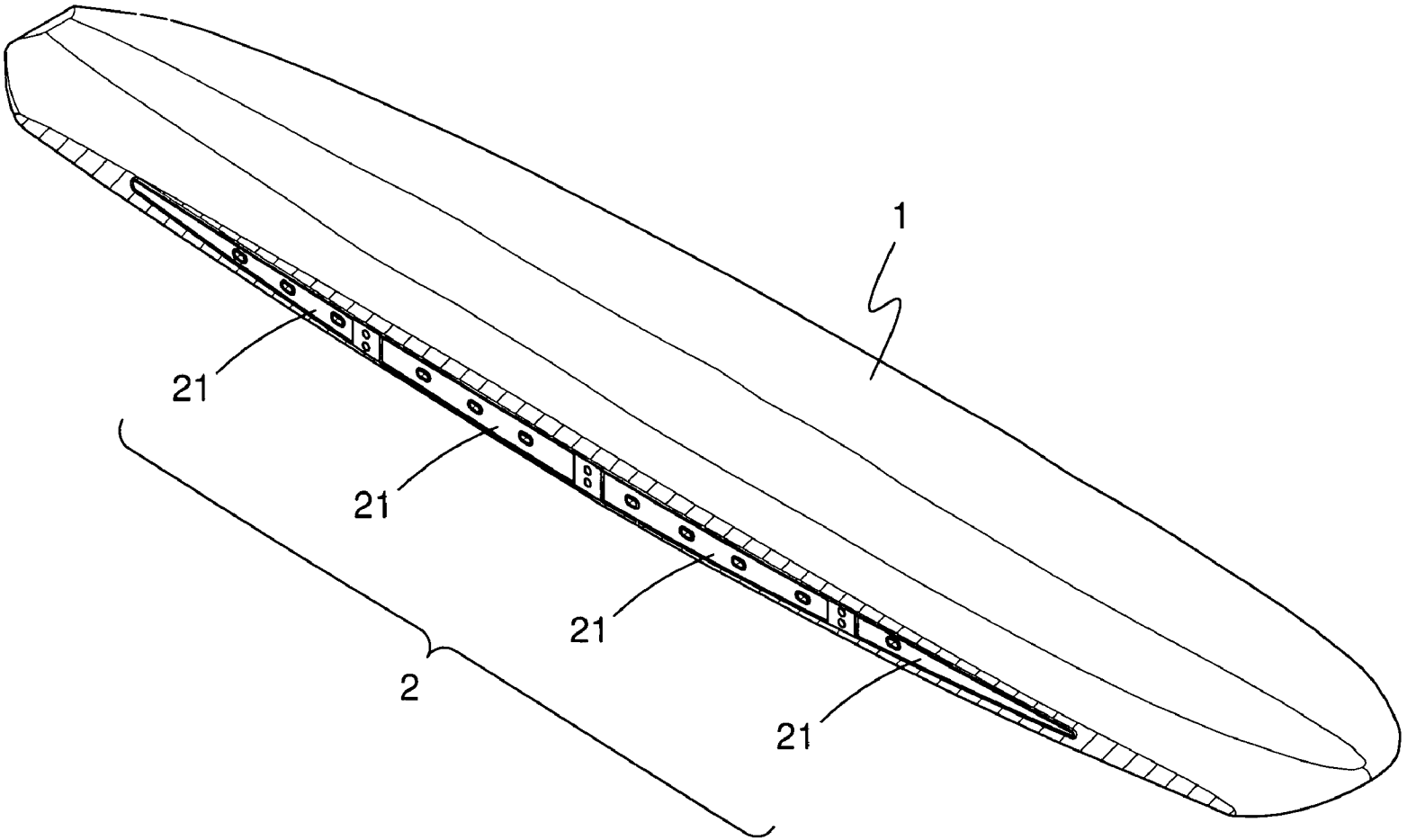
FIG. 1 is a perspective view of a sliding board in accordance with the preferred embodiment of the present invention.
Figure 2:
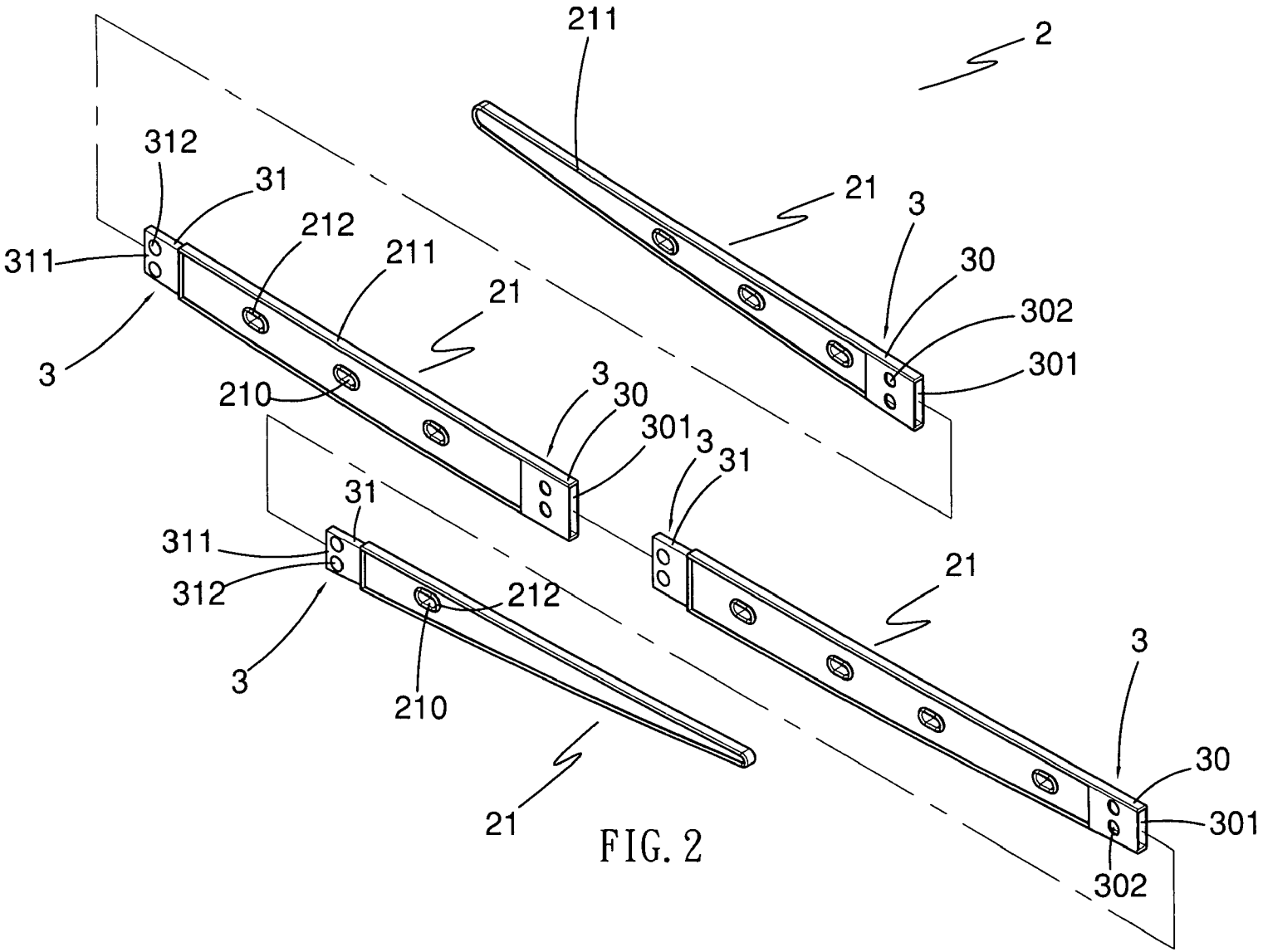
FIG. 2 is an exploded perspective view of a reinforcing unit of the sliding board as shown in FIG. 1.

Referring to the drawings and initially to FIGS. 1 and 2, a sliding board in accordance with the preferred embodiment of the present invention comprises a board body 1, and at least one reinforcing unit 2 mounted in the board body 1. The board body 1 is made of a light material, such as a foam material of PE, PP, PS or the like. The reinforcing unit 2 is used to reinforce the structural strength of the board body 1, so that the board body 1 is not broken, snapped or deformed easily due to a bending force or impact. In the preferred embodiment of the present invention, the sliding board comprises two opposite reinforcing units 2 mounted on two opposite sides of the board body 1. More specifically, the reinforcing unit 2 includes a plurality of reinforcing bars 21 which are connected serially to form the reinforcing unit 2. Each of the intermediate reinforcing bars 21 has two ends each provided with a mounting module 3, and each of the outermost reinforcing bars 21 has one end provided with a mounting module 3. The mounting modules 3 of the reinforcing bars 21 include a female mounting portion 30 and a male mounting portion 31. The female mounting portion 30 of each of the reinforcing bars 21 has an inside formed with a slot 301 and has a side face formed with two snapping holes 302 each connected to the slot 301. The male mounting portion 31 of each of the reinforcing bars 21 is provided with an insert 311 which has a side face formed with two outwardly protruding snapping bosses 312.

Thus, when the male mounting portion 31 is connected with the respective female mounting portion 30, the insert 311 of the male mounting portion 31 is inserted into the slot 301 of the respective female mounting portion 30, and the snapping bosses 312 of the male mounting portion 31 are snapped into and locked in the snapping holes 302 of the respective female mounting portion 30, so that the male mounting portion 31 is combined with the respective female mounting portion 30, and the reinforcing bars 21 are connected rigidly and stably. In addition, the male mounting portion 31 is connected with the respective female mounting portion 30 easily and rapidly, so that the reinforcing bars 21 are connected with each other so as to assemble the reinforcing unit 2 easily and rapidly.

Therefore, the reinforcing bars 21 are connected with each other to assemble the reinforcing unit 2 so that the length of the reinforcing unit 2 is adjustable so as to fit the board body 1 of different length. In addition, each of the reinforcing bars 21 has a smaller length and occupies a smaller space, thereby facilitating packaging, storage and transportation of the reinforcing unit 2, and thereby decreasing the costs of fabrication and production.

Referring to FIG. 2, each of the reinforcing bars 21 has a periphery formed with an outer rib 211 so as to reinforce the structural strength of each of the reinforcing bars 21 and has an inside formed with at least one through hole 210 extended through two opposite side faces of each of the reinforcing bars 21. The through hole 210 of each of the reinforcing bars 21 has a periphery formed with an inner rib 212 so as to reinforce the structural strength of each of the reinforcing bars 21.

Figure 3:
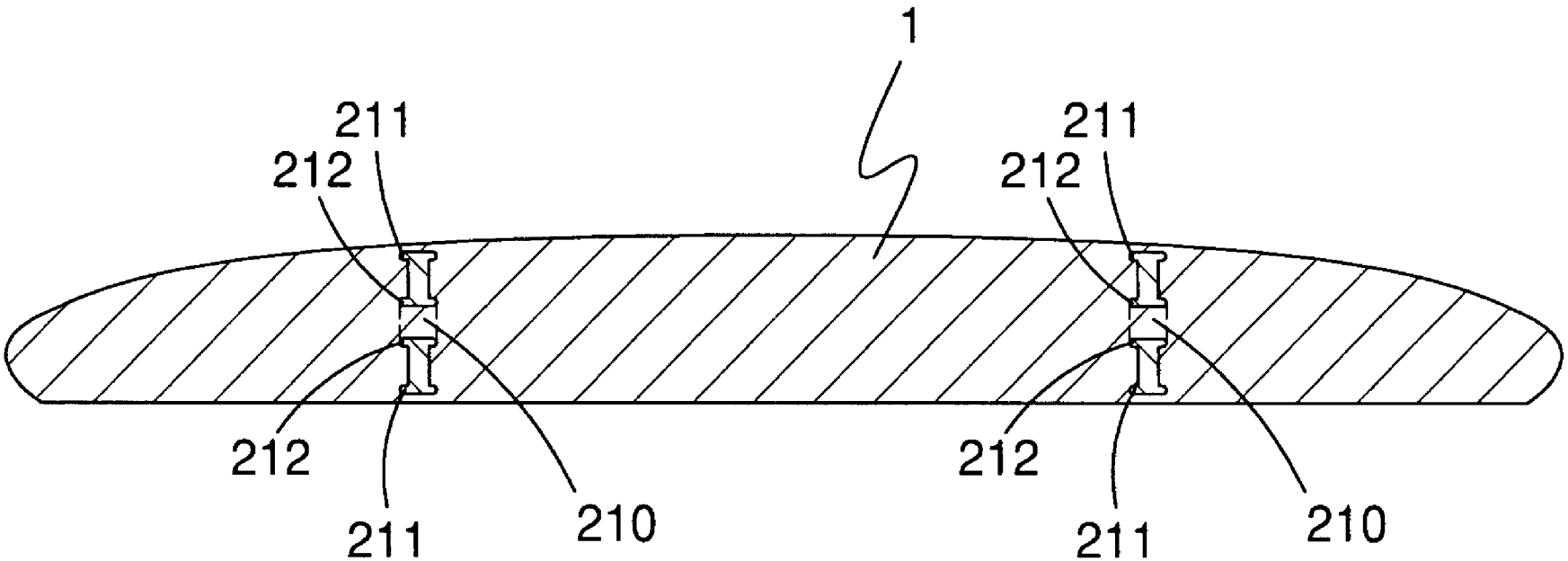
FIG. 3 is a side plan cross-sectional view of the sliding board as shown in FIG. 1.

Referring to FIG. 3, the space formed by the outer rib 211, the space formed by the inner rib 212, and the inner space formed by the through hole 210 are filled with the light material of the board body 1, so that each of the reinforcing bars 21 of the reinforcing unit 2 is combined with the board body 1 closely, thereby enhancing the whole structural strength of the sliding board.

In fabrication of the sliding board, the method for making the sliding board is described as follows. First of all, the reinforcing bars 21 are connected with each other to assemble the reinforcing unit 2. Then, two reinforcing units 2 are placed into a die. Then, particles of foamed material, such as PE, PP, PS or the like, is filled into the die, and pressurized steam at a high temperature is injected into the die, so that the particles of the foamed material are melted and bonded together to form the board body 1 which contains the two reinforcing units 2. Then, the board body 1 together with the two reinforcing units 2 is removed from the die. Finally, a surface layer is bonded onto the top face of the board body 1, and a bottom plate is bonded onto the bottom face of the board body 1, thereby forming the sliding board which contains the board body 1 and the two reinforcing units 2.

Figure 4:
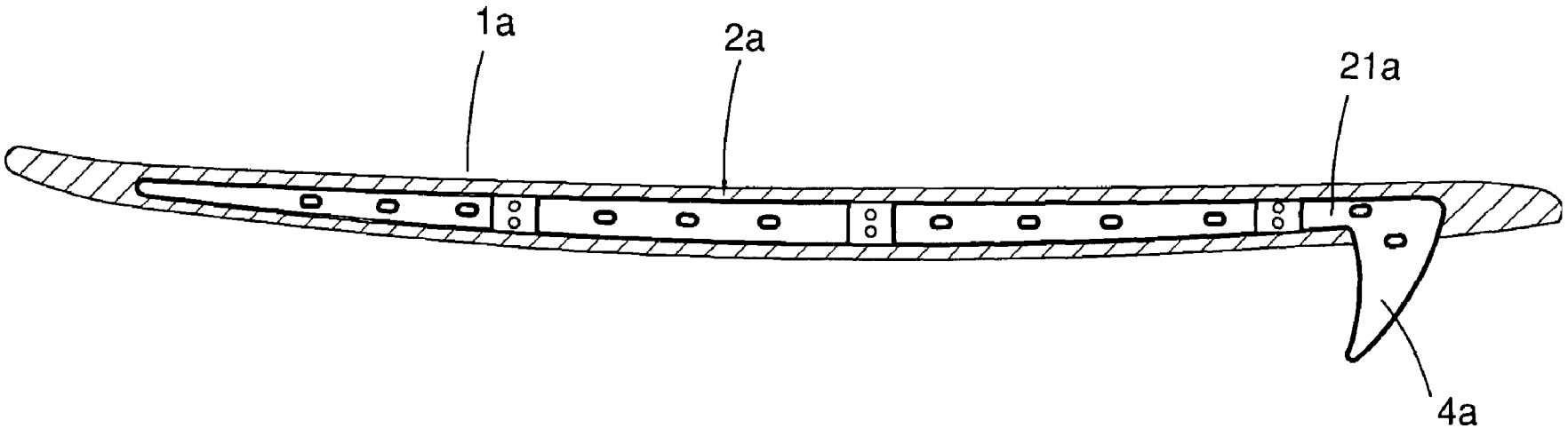
FIG. 4 is a plan cross-sectional view of a sliding board in accordance with another preferred embodiment of the present invention.

Referring to FIG. 4, a sliding board in accordance with another preferred embodiment of the present invention comprises a board body 1*a*, and at least one reinforcing unit 2*a* mounted in the board body 1*a*. The reinforcing unit 2*a* includes a plurality of reinforcing bars 21*a* which are connected serially to form the reinforcing unit 2*a*. The sliding board further comprises a protrusion 4*a* having a first end connected with one of the reinforcing bars 21*a* of the reinforcing unit 2*a* and a second end protruded outwardly from the surface of the board body 1*a*. The second end of the protrusion 4*a* protruded outwardly from a bottom surface of the board body 1*a* has a rudder shape. Thus, the protrusion 4*a* provides a direction guiding function to the sliding board.

Figure 5:
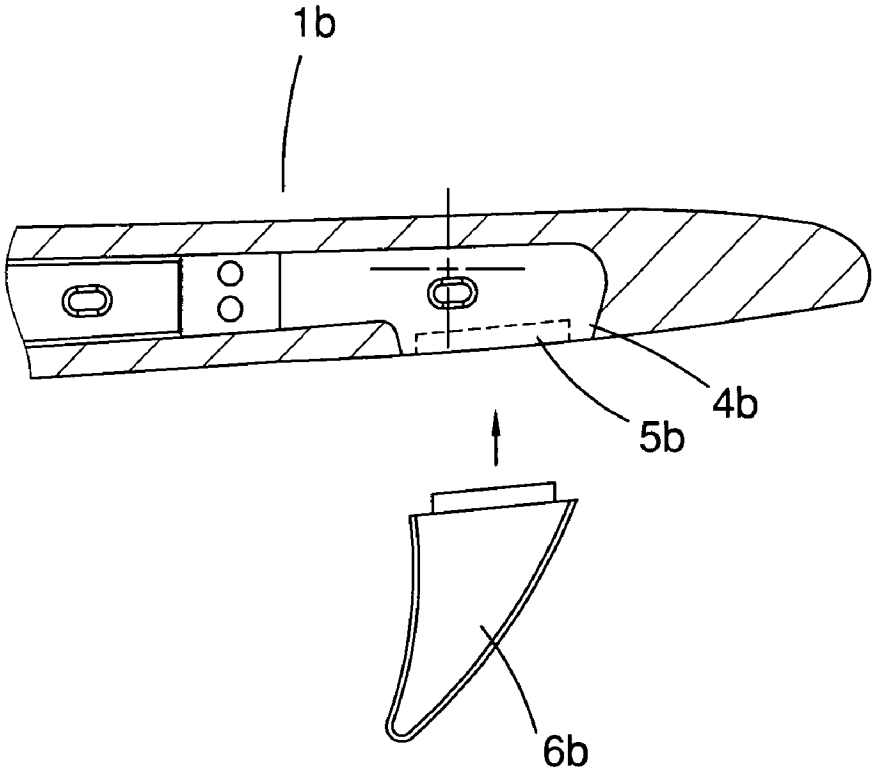
FIG. 5 is a partially plan cross-sectional exploded view of a sliding board in accordance with another preferred embodiment of the present invention.

Referring to FIG. 5, a sliding board in accordance with another preferred embodiment of the present invention comprises a board body 1*b*, and a mounting portion 4*b* mounted on the board body 1*b* and having an inside formed with a fixing hole 5*b* for fixing a rudder 6*b* which is protruded outwardly from a bottom surface of the board body 1*b* to provide a direction guiding function to the sliding board.

Figure 6:
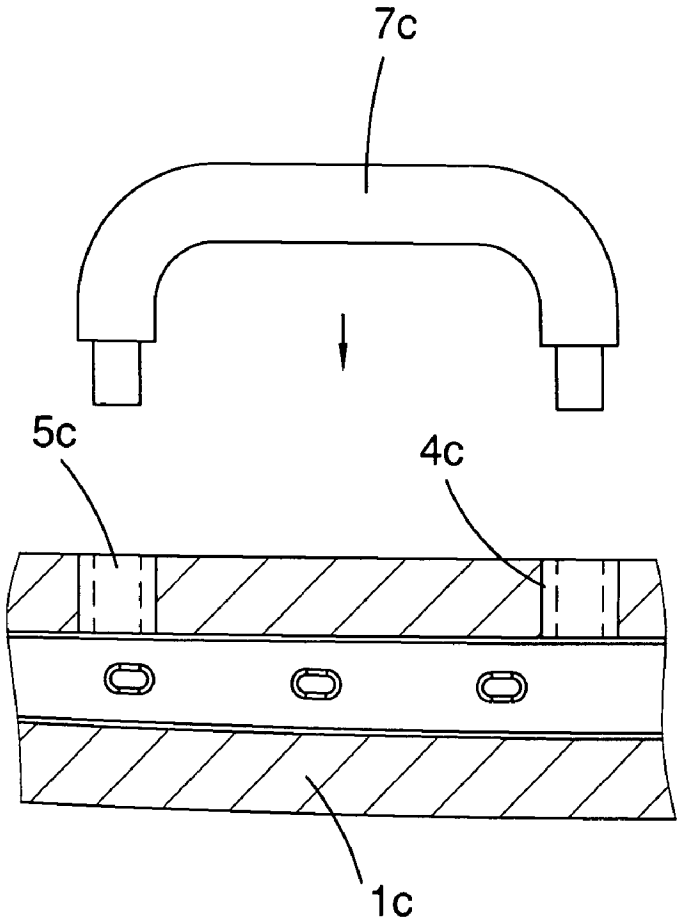
FIG. 6 is a partially plan cross-sectional exploded view of a sliding board in accordance with another preferred embodiment of the present invention.

Referring to FIG. 6, a sliding board in accordance with another preferred embodiment of the present invention comprises a board body 1*c*, two mounting portions 4*c* each mounted on a top surface of the board body 1*c* and each having an inside formed with a fixing hole 5*c*, and an inverted U-shaped handle 7*c* mounted on the mounting portions 4*c* and having two distal ends each fixed in the fixing hole 5*c* of the respective mounting portion 4*c*. Thus, a user can hold the handle 7*c* so as to carry the sliding board.

Accordingly, the reinforcing bars 21 are connected with each other to assemble the reinforcing unit 2 so that the length of the reinforcing unit 2 is adjustable so as to fit the board body 1 of different length. Therefore, the versatilities of the reinforcing unit 2 are available for various board bodies, and the costs of fabrication and production are reduced. Further, the space formed by the outer rib 211, the space formed by the inner rib 212, and the inner space formed by the through hole 210 are filled with the light material of the board body 1, so that each of the reinforcing bars 21 of the reinforcing unit 2 is combined with the board body 1 closely, thereby enhancing the whole structural strength of the sliding board. Further, the insert 311 of the male mounting portion 31 is inserted into the slot 301 of the respective female mounting portion 30, and the snapping bosses 312 of the male mounting portion 31 are snapped into and locked in the snapping holes 302 of the respective female mounting portion 30, so that the male mounting portion 31 is combined with the respective female mounting portion 30, and the reinforcing bars 21 are connected rigidly and stably. Further, the male mounting portion 31 is connected with the respective female mounting portion 30 easily and rapidly, so that the reinforcing bars 21 are connected with each other so as to assemble the reinforcing unit 2 easily and rapidly.

Figure 7:
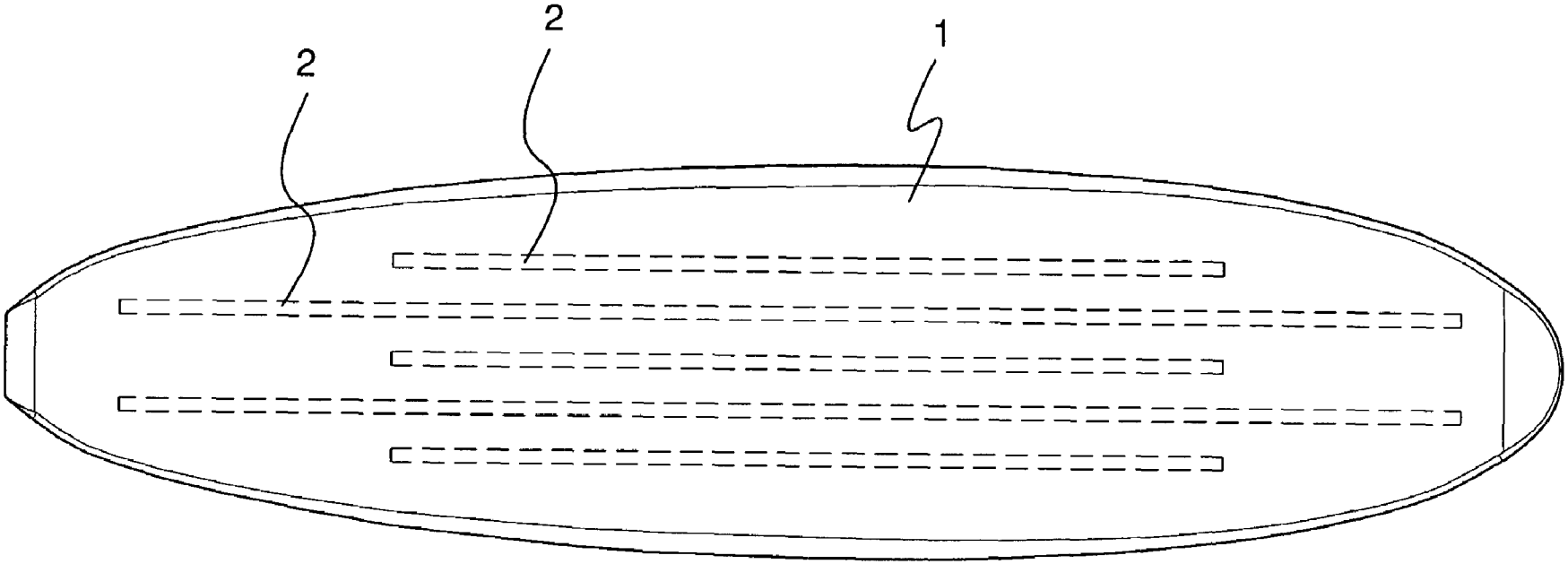
FIG. 7 is a top view of a sliding board of the present invention, showing a preferred arrangement of the reinforcing unit.
Figure 8:
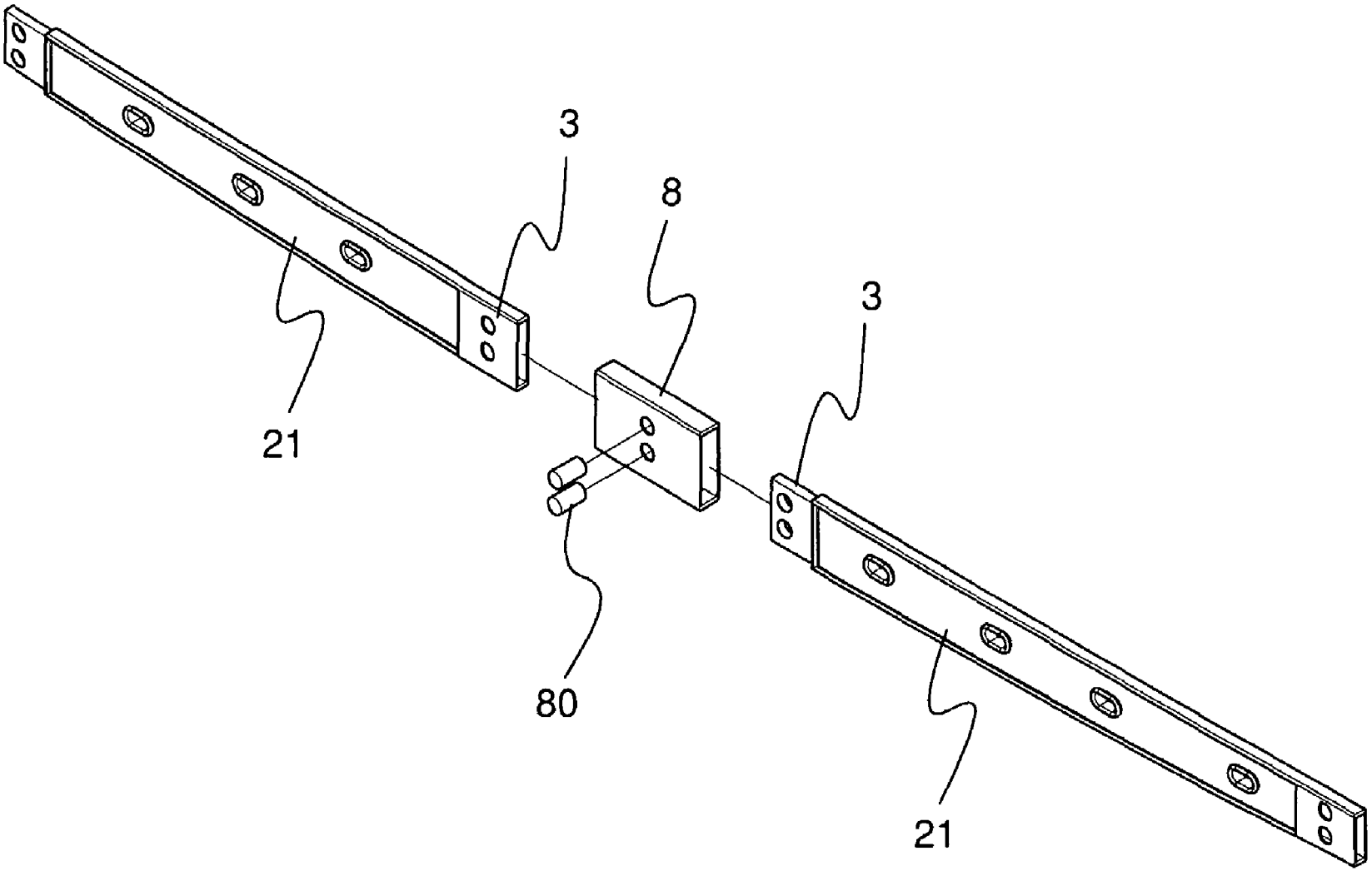
FIG. 8 is an exploded perspective view of the reinforcing unit of the sliding board, showing a reinforcing cover and plural fasteners being provided for connecting mounting modules of reinforcing bars.
Figure 9:
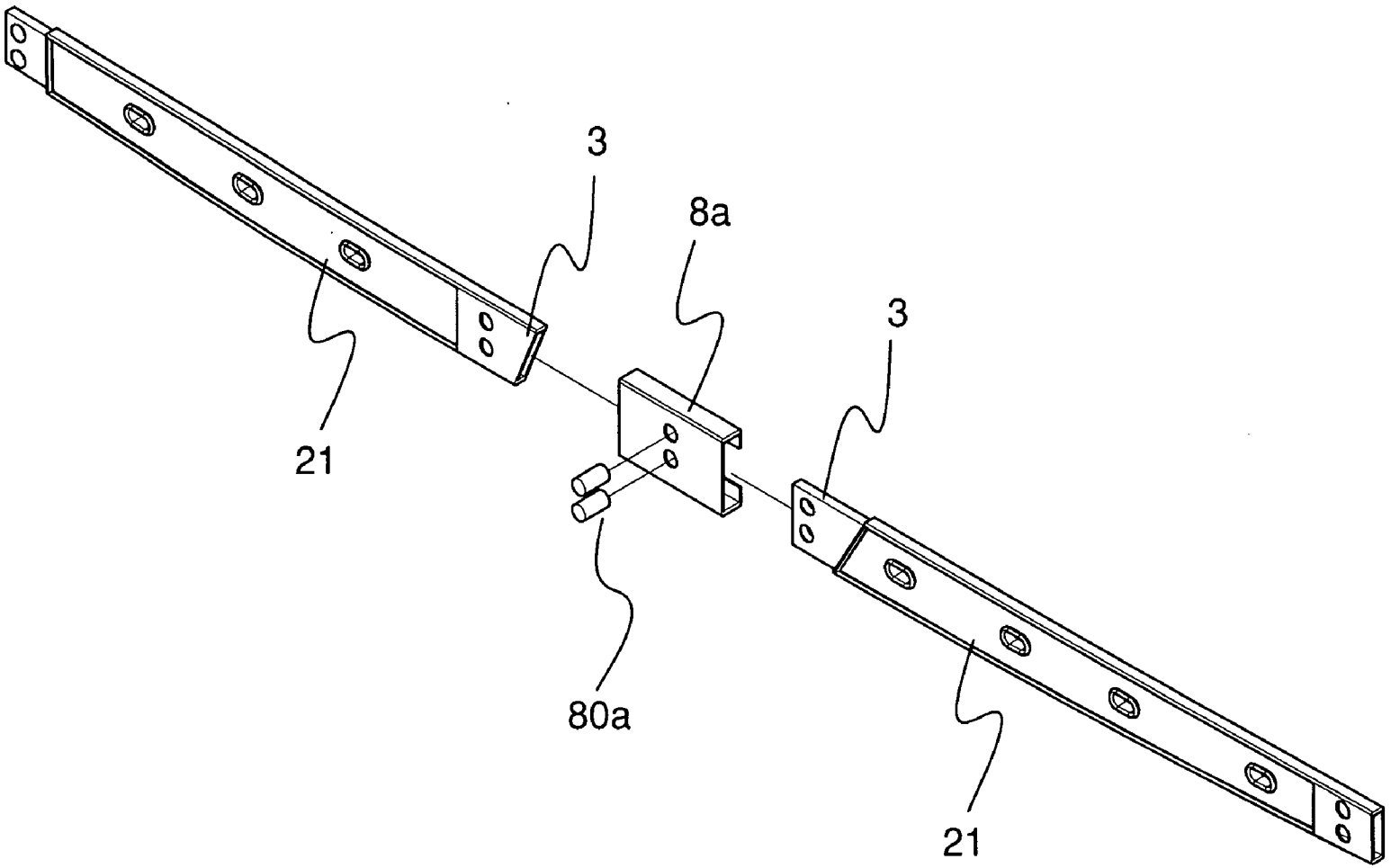
FIG. 9 is an exploded perspective view of the reinforcing unit of the sliding board, showing another reinforcing cover and plural fasteners being provided for connecting mounting modules of reinforcing bars.

Alternative embodiments are possible within the scope of the present invention. For examples, FIG. 7 further shows a preferred arrangement of the reinforcing units 2 to the board body 1, and such an arrangement changes upon the size of the selected board body 1. As shown in FIG. 8, a reinforcing cover 8 and plural fasteners 80 are provided for connecting the mounting modules 3 of the reinforcing bars 21. FIG. 9 further shows that another reinforcing cover 8*a* and fasteners 80*a* are provided for connecting the mounting modules 3 of the reinforcing bars 21. The reinforcing cover 8, 8*a* is particularly covered the joint of the connected mounting modules 3 of the reinforcing bars 21 so as to enhance the connections between the reinforcing bars 21, and the reinforcing cover 8, 8*a* is preferably made of metal or any suitable strong material. The fasteners 80, 80*a* is provided to fasten the connected mounting modules 3 of the reinforcing bars 21 and the reinforcing cover 8, 8*a*, and are preferably rivets, nails, screws and other suitable secure members.

Additionally, the present invention is also applicable to wind surfboards, canoes and the like. The rudder 6*b*, the handle 7*c* or other attachments not only can be connected with the reinforcing units 2 via the mounting portion 4*b*, 4*c*, but also can be connected with any suitable place of the board body 1. Furthermore, the reinforcing units 2 can be covered by a reinforcing skin (not shown) to further enhance the strength of the board body 1.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A sliding board, comprising:

a board body made of a light material; and at least one reinforcing unit mounted in the board body to reinforce a structural strength of the board body and including a plurality of reinforcing bars which are connected serially to form the reinforcing unit, wherein each of the reinforcing bars has an inside formed with at least one through hole extended through two opposite side faces of each of the reinforcing bars, and the through hole of each of the reinforcing bars is filled with the light material of the board body.

2. The sliding board in accordance with claim 1, wherein each of the reinforcing bars has a periphery formed with an outer rib, and a space formed by the outer rib is filled with the light material of the board body.

3. The sliding board in accordance with claim 1, wherein the reinforcing unit includes two outermost reinforcing bars and a plurality of intermediate reinforcing bars, each of the intermediate reinforcing bars has two ends each provided with a mounting module, each of the outermost reinforcing bars has one end provided with a mounting module, the mounting modules of the intermediate reinforcing bars include a female mounting portion and a male mounting portion, the female mounting portion of each of the intermediate reinforcing bars has an inside formed with a slot and has a side face formed with two snapping holes each connected to the slot, the male mounting portion of each of the intermediate reinforcing bars is provided with an insert which has a side face formed with two outwardly protruding snapping bosses, wherein when the male mounting portion is connected with the respective female mounting portion, the insert of the male mounting portion is inserted into the slot of the respective female mounting portion, and the snapping bosses of the male mounting portion are snapped into and locked in the snapping holes of the respective female mounting portion.

4. The sliding board in accordance with claim 3, wherein each of the reinforcing bars has a periphery formed with an outer rib, and a space formed by the outer rib is filled with the light material of the board body.

5. The sliding board in accordance with claim 4, wherein the through hole of each of the reinforcing bars has a periphery formed with an inner rib, and a space formed by the inner rib is filled with the light material of the board body.

6. The sliding board in accordance with claim 1, further comprising a protrusion having a first end connected with one of the reinforcing bars of the reinforcing unit and a second end protruded outwardly from a surface of the board body.

7. The sliding board in accordance with claim 1, further comprising two mounting portions each mounted on a top surface of the board body and each having an inside formed with a fixing hole, and an inverted U-shaped handle mounted on the mounting portions and having two distal ends each fixed in the fixing hole of the respective mounting portion.

8. A reinforcing unit, comprising:

a plurality of reinforcing bars which are connected serially; wherein the reinforcing unit include two outermost reinforcing bars and a plurality of intermediate reinforcing bars;

each of the intermediate reinforcing bars having two ends each provided with a mounting module;

each of the outermost reinforcing bars having one end provided with a mounting module; wherein:

the reinforcing bars are connected by the mounting modules; and each of the reinforcing bars has an inside formed with at least one through hole extended through two opposite side faces of each of the reinforcing bars and has a periphery formed with an outer rib forming a space.

9. The reinforcing unit in accordance with claim 8, further comprising a protrusion having a first end connected with one of the reinforcing bars and a second end protruded outwardly from a surface of the reinforcing bars.

10. The reinforcing unit in accordance with claim 8, further comprising:

at least one reinforcing cover to cover joints of the mounting modules of the reinforcing bars; and plural fasteners to fasten the mounting modules of the reinforcing bars and the reinforcing cover.

11. A reinforcing unit, comprising:

a plurality of reinforcing bars which are connected serially; wherein the reinforcing unit includes two outermost reinforcing bars and a plurality of intermediate reinforcing bars;

each of the intermediate reinforcing bars having two ends each provided with a mounting module;

each of the outermost reinforcing bars having one end provided with a mounting module;

the reinforcing bars are connected by the mounting modules; wherein:

the mounting modules of the intermediate reinforcing bars include a female mounting portion and a male mounting portion, the female mounting portion of each of the intermediate reinforcing bars has an inside formed with a slot and has a side face formed with two snapping holes each connected to the slot, the male mounting portion of each of the intermediate reinforcing bars is provided with an insert which has a side face formed with two outwardly protruding snapping bosses, wherein when the male mounting portion is connected with the respective female mounting portion, the insert of the male mounting portion is inserted into the slot of the respective female mounting portion, and the snapping bosses of the male mounting portion are snapped into and locked in the snapping holes of the respective female mounting portion.

12. The reinforcing unit in accordance with claim 11, wherein each of the reinforcing bars has an inside formed with at least one through hole extended through two opposite side faces of each of the reinforcing bars.

13. The reinforcing unit in accordance with claim 11, wherein each of the reinforcing bars has a periphery formed with an outer rib forming a space.

14. The reinforcing unit in accordance with claim 11, further comprising a protrusion having a first end connected with one of the reinforcing bars and a second end protruded outwardly from a surface of the reinforcing bars.

15. The reinforcing unit in accordance with claim 11, further comprising:

at least one reinforcing cover to cover joints of the mounting modules of the reinforcing bars; and plural fasteners to fasten the mounting modules of the reinforcing bars and the reinforcing cover.

* * * * *